US006102106A

United States Patent [19]

Manning et al.

[11] Patent Number: 6,102,106

[45] Date of Patent: Aug. 15, 2000

[54] METHOD OF SERVICING A HELICAL COIL HEAT EXCHANGER WITH REMOVABLE END PLATES

[75] Inventors: Frank E. Manning, Valley Center; Ronald L. Grace, Fallbrook, both of Calif.

[73] Assignee: Flowserve Management Company, Irving, Tex.

[21] Appl. No.: 09/353,566

[22] Filed: Jul. 14, 1999

Related U.S. Application Data

[62] Division of application No. 09/001,639, Dec. 31, 1997.

[51] Int. Cl.[7] ..... F28F 7/00

[52] U.S. Cl. ..... 165/76; 165/163; 29/890.031

[58] Field of Search ..... 165/76, 163, 156; 29/890.031

[56] References Cited

U.S. PATENT DOCUMENTS

| | | | |
|---|---|---|---|
| 1,068,742 | 7/1913 | Dahl . | |
| 1,911,464 | 5/1933 | Pearson . | |
| 1,920,598 | 8/1933 | Schirmer . | |
| 1,944,894 | 1/1934 | Kennedy . | |
| 2,039,066 | 4/1936 | De Weese . | |
| 2,146,141 | 2/1939 | Harris . | |
| 2,160,898 | 6/1939 | Peff . | |
| 2,508,247 | 5/1950 | Giauque . | |
| 2,668,692 | 2/1954 | Hammell . | |
| 2,888,251 | 5/1959 | Dalin . | |
| 3,100,523 | 8/1963 | Marrujo . | |
| 3,286,767 | 11/1966 | Evans . | |
| 3,522,840 | 8/1970 | Wentworth, Jr. . | |
| 3,526,273 | 9/1970 | Wentworth, Jr. | 165/163 |
| 3,557,868 | 1/1971 | Burkell . | |
| 3,802,499 | 4/1974 | Garcea | 165/163 |
| 4,190,104 | 2/1980 | Frei . | |
| 4,313,491 | 2/1982 | Molitor . | |
| 4,669,533 | 6/1987 | Hehl . | |
| 4,895,203 | 1/1990 | McLaren | 165/41 |
| 5,046,548 | 9/1991 | Tilly . | |
| 5,309,987 | 5/1994 | Carlson . | |
| 5,379,832 | 1/1995 | Dempsey . | |
| 5,682,947 | 11/1997 | McFarlane | 165/163 |
| 5,845,704 | 12/1998 | Lavelle et al. | 165/163 |

FOREIGN PATENT DOCUMENTS

| | | |
|---|---|---|
| 3146460 | 6/1983 | Germany . |
| 1746185 | 7/1992 | U.S.S.R. . |

*Primary Examiner*—Allen Flanigan
*Attorney, Agent, or Firm*—Flynn, Thiel, Boutell & Tanis, P.C.

[57] ABSTRACT

A heat exchanger for heat exchange between a working fluid and a coolant having an inner casing, an outer casing, and an annular space formed therebetween. A tube bundle including at least one tube formed into a helical coil is located within the annular space. End plates are removably secured and sealed to the ends of the outer casing. Bulkhead fittings are mounted in openings of the end plates to seal the tube ends which pass through the end plates. The bulkhead fittings are sized to permit the end plates to be moved off of the bulkhead fittings in a direction away from the helical coil. The tube bundle may also include a separating plate extending longitudinally between the coils of two tubes within the tube bundle creating two separate passages through which coolant may flow. External tubes may be connected at the tube ends, outside of the outer casing and the end plates, such that the working fluid flows in a parallel single-pass flow or a series double-pass flow through the annular space. A method for servicing the heat exchanger includes disconnecting the heat exchanger from a fluid delivery tube and a fluid return tube, removing the end plates off of the bulkhead fittings in a direction away from the helical coil, removing the inner and outer casings off of the tube bundle, and servicing the tube bundle.

11 Claims, 6 Drawing Sheets

METHOD OF SERVICING A HELICAL COIL HEAT EXCHANGER WITH REMOVABLE END PLATES

This application is a division of application Ser. No. 09/001,639, filed Dec. 31, 1997.

The present invention relates generally to the field of heat exchangers and, more particularly, to an improved heat exchanger having a casing and helical coils located in an annular space of the casing, wherein the helical coils have ends that extend out each end of the casing.

BACKGROUND OF THE INVENTION

Heat exchangers have long been used to raise or lower the temperature of a working fluid. Several basic designs accomplish this end, but invariably each relies on the basic principle of thermodynamics that thermal energy will tend to migrate from a warm body to a cooler one. One common type of heat exchanger circulates the working fluid through a tube which is immersed in a bath of coolant contained within a casing. Thus the thermal energy will pass from the hotter of the two fluids, through the walls of the tube, to the cooler fluid. The rate of energy transfer is the greatest where the temperature gradient is large, and decreases as the temperature of both fluids approaches equilibrium.

Since the thermal energy transfer between the fluids increases as the surface area of the tube increases, the tube is ideally wound into a coil or otherwise condensed in size to maximize the surface area exposed to the fluids while minimizing the size of the casing. Moreover, in order to maintain continuous operation, fresh coolant is preferably circulated through the casing.

One particularly efficient design that incorporates both of these features is described in U.S. Pat. No. 3,526,273, to Wentworth (the "Wentworth patent"), which is incorporated herein by reference. This patent describes a heat exchanger in which the casing defines a cylindrical annular space, and the tube is wrapped into a helical coil which fits inside the annular space. The bottom end of the annular space is closed by an endwall, and on the top end there is a detachable cover. Both the inlet and outlet ends of the tube extend through the cover, and the coil is wrapped into multiple overlapping layers that spiral alternatingly between the endwall and the cover. Coolant is introduced into the casing through a second set of ports in the cover, and circulates around the outside of the tube in a spiral path corresponding to the turns of the helical coil. By forcing the coolant to travel along the path of the spiraling tube, heat transfer between the fluids is maximized. Also since the cover is detachable, the helical coil may be pulled from the annular space for maintenance and/or cleaning.

While the above described heat exchanger functions quite well, it does have its disadvantages. One disadvantage of this earlier design is the difficulty of venting and draining the tube coil. Venting of entrapped gasses inside the coil is very important because without proper venting these gases can severely impede the flow of fluid within the coil. This results in ineffective cooling or stalled flow, which can cause severe overheating. Venting of the coil to remove entrapped gases is difficult unless the heat exchanger is mounted in a vertical upright position with inlet and outlet fittings on top. However, when placed in this vertical position the coil cannot be drained. If the heat exchanger is placed on it's side (axis placed horizontal to the ground) both venting and draining become very difficult. Also, when the heat exchanger is placed on its side, sediment settles on the bottom of the casing obstructing the flow of coolant.

The earlier design has another disadvantage in that both the working fluid and the coolant flow down the case through one layer of the coil and back up the case through the adjacent layer of the coil. This double pass flow design increases the dwell time during which the coolant remains in the heat exchanger and results in an increased rise of temperature of the coolant.

An additional disadvantage is the difficulty of removing the coil from the casing for cleaning. The coolant (usually water) is in direct contact with the coil as well as the casing walls. Thus any impurities from the coolant, as well as any corrosion of the casing walls and tubes caused by the coolant, will eventually build-up restricting coolant flow and decrease the interval period between cleanings. To the extent that this build-up creates a bond between the coil and the casing, it becomes increasingly difficult, if not impossible, to remove the coil assembly from the casing without severe deformation to the coil in order to accomplish cleanings. In particular, build-ups are also an increasing problem due to increasing environmental restrictions on chemical treatment of cooling water to remove impurities.

When the coil assembly is to be removed from the casing it must be pulled from the open top end. This removal process almost invariably results in stretching of the coil, making reassembly difficult. In cases of severe build-up the coil will most likely be damaged when removed and the coil, and possibly the heat exchanger, will have to be replaced.

Another type of heat exchanger is described in U.S. Pat. No. 3,803,499 to Garcea. This heat exchanger discloses one finned tube formed into a single helical coil which passes through the casing, wherein coolant flows, and allows the working fluid to make one pass through the casing. A tie-rod passes through the axial bore of the heat exchanger to hold the end covers in place and thus secures the components of the heat exchanger.

A disadvantage of this design is that it discloses only one tube. By only using one tube the amount of working fluid per interval of time that passes through the casing is limited. An additional disadvantage is the difficulty of removing the coil from the casing for cleaning. The coolant is in direct contact with the coil as well as the casing walls, thus impurities can build-up between the casing walls and the coils creating many problems including increased difficulty in removal of the coils for cleaning. Furthermore, there appear to be supports that extend radially outward from the top and bottom of the inner cylindrical wall that extend partially around the top and bottom convolutions of the helical coil which would also restrict removal of the coil from the casing.

A combined heat exchanger and homogenizer titled "Device for Preparing Putty and Similar Masses" is described in U.S. Pat. No. 5,046,548 to Tilly. This patent discloses dual helical tubes within a casing, an additional tube located along the axial bore of the heat exchanger, and end plates. This device heats and homogenizes viscous masses, particularly putty. The putty passes through the casing under pressure and heating. The dual helical tubes and the additional tube located along the axial bore of the heat exchanger act as guiding devices to force the putty into a plurality of directional changes.

The above-described heat exchanger and homogenizer has many disadvantages in terms of operation as a conventional heat exchanger. One disadvantage is that it includes a straight heat exchanger tube located along the axial bore of the heat exchanger which extends through both the bottom and top end plates. As mentioned previously, tubes are ideally wound into a coil to maximize the surface area exposed to the fluids while minimizing the size of the case. The straight heat exchanger is very inefficient for the purposes of heat transfer and further is an inefficient use of space.

An additional disadvantage of this structure is that the dual helical coils are not sandwiched between an inner casing and an outer casing. The dual helical coils are instead arranged around and spaced from a straight heat exchanger tube located along the axial bore of the heat exchanger which extends through both the bottom and top end plates. As a result, flow through the casing is not adequately restricted nor channeled sufficiently over the dual helical coils. Therefore coolant will not be forced over the coils adequately nor will the coolant spiral satisfactorily over the coils A further disadvantage of this structure is that it only has a single chamber through which fluid may flow. The single chamber contains dual helical coils and an additional tube located along the axial bore of the single chamber which act as guiding devices to force viscous masses, particularly putty, into a plurality of directional changes. While the single chamber is apparently useful for homogenizing putty, it is inadequate for channeling fluid flow sufficiently over each individual coil in isolation from the other coil. Therefore coolant will not be restricted to flow through a separate chamber containing an individual coil and thus will not flow and spiral adequately over each individual coil. This results in an inefficient method of heat transfer between each individual coil and the coolant.

In view of the above, it should be appreciated that there is a need for an improved heat exchanger that provides the advantages of having a multiple tube helical coil configuration arranged within a shell assembly which allows differing flow patterns for working fluids, permits simplified venting and draining, allows coolant to pass through the shell assembly in a single pass flow through design, prevents the significant build-up of impurities or corrosive bonding between the multiple coiled tubes and the casing walls due to the circulation of coolant, channels coolant efficiently over the multiple coiled tubes, and enables easy removal of the multiple coiled tubes from the shell assembly for periodic cleaning or maintenance with little or no damage. The present invention satisfies these and other needs and provides further related advantages.

SUMMARY OF THE INVENTION

The present invention is embodied in an improved heat exchanger having a multiple tube helical coil configuration arranged within a shell assembly which allows differing flow patterns for working fluids such as a single pass or a double pass flow pattern, eliminates the possibility of working fluid leakage at tube connections that could contaminate the coolant, permits simplified venting and draining, and allows coolant to pass through the shell assembly in a single pass flow through design. Furthermore, this improved heat exchanger, in combination with other features described below, possesses a pressure release means, prevents the significant build-up of impurities or corrosive bonding between the coiled tubes and the casing walls due to the circulation of coolant, channels coolant efficiently over the coiled tubes, and enables easy removal of the coiled tubes from the shell assembly for periodic cleaning or maintenance with little or no damage to the coiled tubes. In addition, this improved heat exchanger accomplishes these ends through a design that is both simple and inexpensive to manufacture.

The improved heat exchanger includes a shell assembly having inner and outer casings, wherein the inner casing is within and spaced from the outer casing to form an annular space therebetween. A removable top end plate may be detachably fixed to a top end of the shell assembly enclosing the top end of the formed annular space and abutting the inner and outer casing. A removable bottom end plate may be detachably fixed to a bottom end of the shell assembly enclosing the bottom end of the formed annular space and abutting the inner and outer casing. Two tubes, an inner coiled tube and an outer coiled tube, are located within the annular space of the shell assembly. Furthermore, both of these tubes are formed into helical coils which encircle the inner casing and have ends that extend through the top end plate and the bottom end plate.

An important feature of the present invention is that the ends of the coiled tubes can be provided with fluid inlet or outlet connections that are external to the shell assembly. An advantage of external connections is that different tube configurations can be attached to the fluid inlet or outlet connections of the tube ends, outside of the shell assembly, allowing different flow patterns through the improved heat exchanger, allowing greater flexibility of use. For example, external tube configurations can be connected to the tube ends such that the working fluid makes two passes through the improved heat exchanger, once through the outer coiled tube and next through the inner coiled tube, or vice-versa, allowing the working fluid to be cooled two times by heat transfer with the coolant. Alternatively, external tube configurations can be connected to the tube ends such that the working fluid makes only one pass through the improved heat exchanger, once through both the outer and inner coiled tubes at the same time, increasing the amount of working fluid that can be passed through the improved heat exchanger per interval of time. An additional advantage of the use of external tube connections is that it eliminates the possibility of working fluid leakage at tube connections within the casing which would contaminate the coolant.

Another feature of the present invention is that a high point vent can be attached at one of the external tube connections above the shell assembly to allow venting of the coiled tubes. This is advantageous because venting of the coiled tubes eliminates entrapped gasses and vapor pockets formed within the coiled tubes which can severely impede the flow of the working fluid within the heat exchanger loop. The results of ineffective venting may include the ineffective cooling of the working fluid or even the stalled flow of the working fluid which can cause severe overheating.

Also, a low point drain may be attached at one of the external tube connections below the shell assembly to allow the draining of the two coiled tubes. This is beneficial because it allows the working fluid within the improved heat exchanger to be completely drained when cleaning or maintenance is required. Since all the tube connections are outside of the shell assembly it is easy to plumb the heat exchanger to achieve the desired venting and draining.

A further feature of the present invention is that it allows coolant to pass over the two coiled tubes in a single pass flow through design. Coolant enters the shell assembly through a coolant inlet port in one end plate and exits through a coolant outlet port in another end plate. The two tubes, the inner coiled tube and the outer coiled tube, may be separated by a separating plate which creates two separate chambers within the annular space of the shell assembly wherein each chamber contains one of the coiled tubes. Therefore the coolant's flow is channeled through each separate chamber in a helical path between each convolution of the coils of each individual coiled tube. This is advantageous in that the amount of coolant that reaches the surface area of the coiled tubes is maximized by the channeling effect of the separate chambers and therefore heat transfer is also maximized. A further advantage of this single pass design is that the coolant encounters minimal flow resistance and thus flows rapidly through the shell assembly, maintaining a high temperature delta between the coolant and the working fluid. Another advantage is that the coolant can also be introduced at the coolant outlet port and thus flow in reverse towards the hotter working fluid inlet side. This can reduce thermal shock and help reduce scaling. Also, since the cooling liquid flows directly through the shell assembly, it can carry small particles of rust and dirt with it. This can help reduce solids build-up within the shell assembly.

An additional feature of the present invention is that it possesses a means to relieve pressure from within the shell assembly. The top end plate and the bottom end plate are secured to the outer casing by the use of a single threaded center bolt which extends along the axial bore of the inner casing, through the end plates, and which detachably fixes the end plates by the use of a nut located at the top end and the bottom end of the bolt. Both the top and bottom end plates may have an outer groove. O-rings fit within these outer grooves which seal the end plates to the outer casing. The center bolt may be designed to limit pressure build-up within the shell assembly. At a specified pressure, the center bolt will elongate to permit the top end plate and the bottom end plate to separate from the outer casing. At this point the O-rings sealing the outer casing to the end plates will unseat and relieve pressure from within the shell assembly. The center bolt size and torque can be designed to meet normal shell assembly pressure requirements and provide for over pressure protection.

A further significant feature of the present invention is the ease of removal of the two coiled tubes from the shell assembly for periodic cleaning or maintenance with little or no damage to the coiled tubes. A tube bundle consisting of the inner coiled tube, the outer coiled tube, the separating plate, an inner baffle, and an outer baffle is located within the annular space of the shell assembly. The inner baffle can be placed adjacent to the inner diameter of the inner coiled tube to separate the inner coiled tube from the inner casing. The outer baffle can be placed adjacent to the outer diameter of the outer coiled tube to separate the outer coiled tube from the outer casing. The tube bundle can be removed from the shell assembly by first removing the top and bottom end plates from the shell assembly and then removing the inner and outer casings from the tube bundle. The tube bundle is then ready for servicing. Note that regardless of whether the coolant has created an impurity build-up or corrosive bonding between the coiled tubes and the baffles, the interface between the baffles and the casings will remain relatively smooth so as not to hinder removal of the tube bundle. This removal method is very advantageous in that there is no need to pull on the ends of the tubes to separate the tube bundle from the casings, in fact the axial stress load during removal is largely supported by the baffles. Since there is very little stress load put upon the coiled tubes during the removal process there is little or no chance of damage or deformation to the coiled tubes.

An additional feature of the present invention is that the tube bundles can be lengthened or shortened to accommodate various heat transfer requirements while retaining the same end plates and fittings. This is advantageous because even if the heat transfer requirements of a system change, the same improved heat exchanger design can be used along with many of the same parts, and thus the expense of designing another heat exchanger can be obviated.

A further feature of the present invention is that it can constructed from standard pipes and common hardware. This is advantageous because by using standard pipes and common hardware a cost effective corrosion resistant improved heat exchanger can be constructed from readily available parts. Therefore, the improved heat exchanger design is both simple and inexpensive to manufacture.

Other features and advantages of the present invention will become apparent from the following description of the preferred embodiments, taken in conjunction with the accompanying drawings, which illustrate, by way of example, the principles of the invention.

DETAILED DESCRIPTION OF THE PREFERRED EMBODIMENTS

Figure 1:
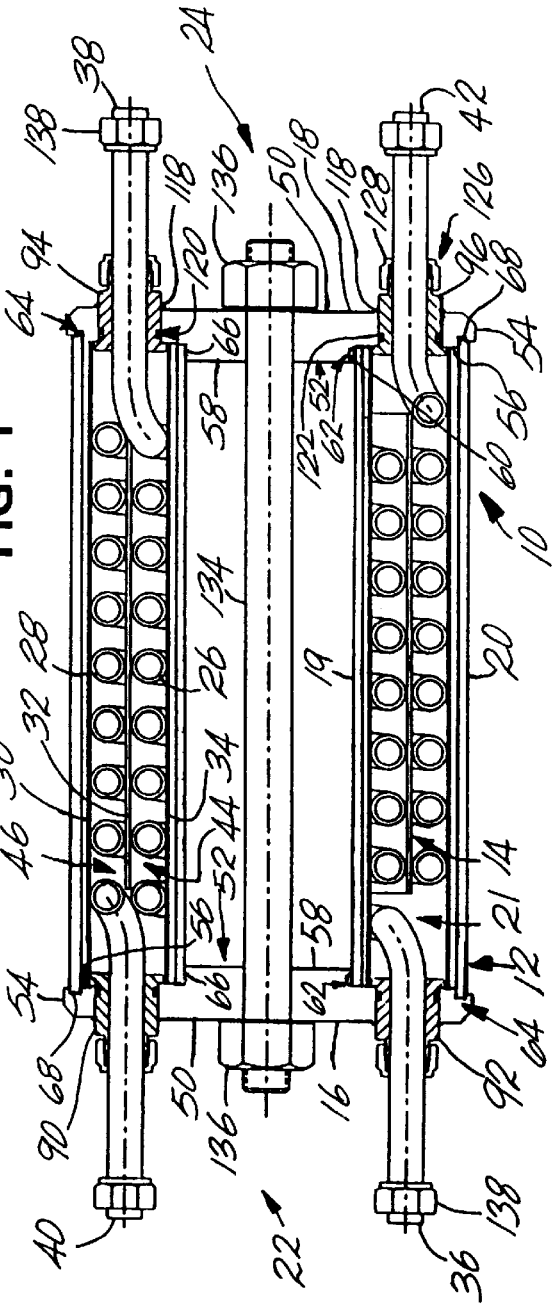
FIG. 1 is a longitudinal sectional view of an improved heat exchanger according to the present invention.

As shown in the exemplary drawings, and with particular reference to FIG. 1, the present invention is embodied in a heat exchanger 10 for use in transferring thermal energy between a fluid and a coolant. The improved heat exchanger 10 includes a shell assembly 12, a tube bundle 14, a detachable bottom end plate 16, and a detachable top end plate 18.

The shell assembly 12 includes an inner casing 19 which is spaced radially inward from an outer casing 20 forming an annular space 21 between them. Both the inner casing 19 and the outer casing 20 of the improved heat exchanger 10 are preferably cylindrical and can be made from standard pipe, such as Schedule 40 Pipe, or mechanical tubing. At a first end 22 of the shell assembly 12, hereinafter referred to as the bottom end, the annular space is open. Likewise at a second end 24 of the shell assembly 12, hereinafter the top end, the annular space is also open.

The tube bundle 14 consists of an inner coiled tube 26, an outer coiled tube 28, an outer baffle 30, a separating plate 32, and an inner baffle 34. The inner and outer coiled tubes 26 and 28, which are positioned within the annular space 21 of the shell assembly 12, each comprises a single length of tubing, which is preferably made from corrosion resistant materials such as copper or stainless steel. The inner coiled tube 26 is wrapped into a multiple layered helical coil which spirals around the inner casing 19 between the bottom and top ends 22 and 24 of the shell assembly 12. A first end 36 of the inner coiled tube 26 bends away from the turns of the coil and extends out the bottom end 22 of the shell assembly 12. A second end 38 of the inner coiled tube 26 bends away from the turns of the coil and extend out the top end 24 of the shell assembly 12. Likewise, a first end 40 of the outer coiled tube 28 bends away from the turns of the coil and extends out the bottom end 22 of the shell assembly 12. A second end 42 of the outer coiled tube 28 bends away from the turns of the coil and extends out the top end 24 of the shell assembly 12.

In practice, the inner coiled tube 26 is most easily formed into a coil on a mandrel. The inner coiled tube 26 is wound in a spiral fashion around the mandrel until the desired length of coil is reached. The outer coiled tube 28 is also most easily formed into a coil on a mandrel (not illustrated) of slightly larger diameter than that used for the inner coiled tube 26. The coil of the outer coiled tube 28 can then be placed around the coil of inner coiled tube 26 and there will exist a small space between the two coils. Preferably, the separating plate 32 is placed within this small space between the two coils to isolate the two coils from one another. While the preferred embodiment illustrates only two tube coils, one skilled in the art would understand that more tube coils could be used depending upon the size of the annular space and the diameter of the tube coils to be placed therein.

The outer baffle 30 surrounds the outer diameter of the coil of the outer coiled tube 28. The inner baffle 34 is adjacent to the inner diameter of the coil of the inner coiled tube 26. Preferably, the inner baffle 34, the outer baffle 30, and the separating plate 32 are each formed from a flat, flexible sheet of material which is wrapped adjacent to the respective surfaces of the tube coils. Typical material is a corrosion resistant material such as stainless steel. Although in certain applications, a non-corrosion resistant material may be used. The inner baffle 34 may be wrapped into a cylindrical coil and formed such that it has a larger diameter than that of the inner coiled tube 26. When the inner baffle 34 is then placed within the inner coiled tube 26 it must be squeezed to fit within the inner coiled tube 26. Therefore the inner baffle 34 is biased to spring outward and rests firmly against the inner diameter of the inner coiled tube 26. The outer baffle 30 may be wrapped into a cylindrical coil and formed such that it has a smaller diameter than that of the outer coiled tube 28. When the outer baffle 30 is then stretched around the outer coiled tube 28, it is biased to wrap around the outer coiled tube 28 and surrounds the outer coiled tube 28 firmly.

The outer baffle 30 preferably has a great circumferential length than the outer periphery of the outer coiled tube 28. Similarly, the inner baffle 34 preferably has a great circumferential length than the inner periphery of the inner coiled tube 26. Therefore, there will be a slight overlap along both the outer and inner baffles 30 and 34 and the slits formed along the overlaps provide edges by which the baffles can be grasped for removal. Note that an adhesive (not illustrated) may also be used to at least temporarily adhere the baffles to the tube coils before the tube bundle is inserted into the annular space 21 of the shell assembly 12. However, the adhesive should not be so strong as to cause damage to the coils of the inner and outer coiled tubes 26 and 28 when the baffles are subsequently removed for cleaning.

After the tube bundle 14 has been inserted into the shell assembly 12, the baffles will isolate the surfaces of both the coils of the inner and outer coiled tubes 26 and 28, respectively, from the inner and outer casings 19 and 20, respectively. The baffles are described in more detail in the patent application for Heat Exchanger Baffle Design, U.S. patent application Ser. No. 08/857,797, to Lavelle and Grace, filed May 15, 1997 and is incorporated herein by reference.

Furthermore, the separating plate 32 isolates the inner coiled tube 26 from the outer coiled tube 28 and creates two separate chambers within the shell assembly 12. The first separate chamber 44 is formed between the separating plate 32 and the inner baffle 34 and contains the inner coiled tube 26. The second separate chamber 46 is formed between the separating plate 32 and the outer baffle 30 and contains the outer coiled tube 28.

Figure 3:
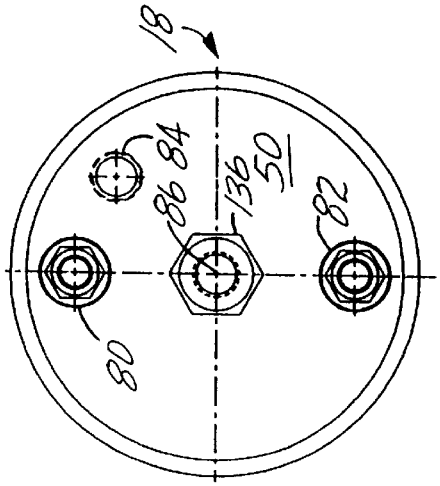
FIG. 3 is a top end view of the improved heat exchanger FIG. 1.
Figure 2:
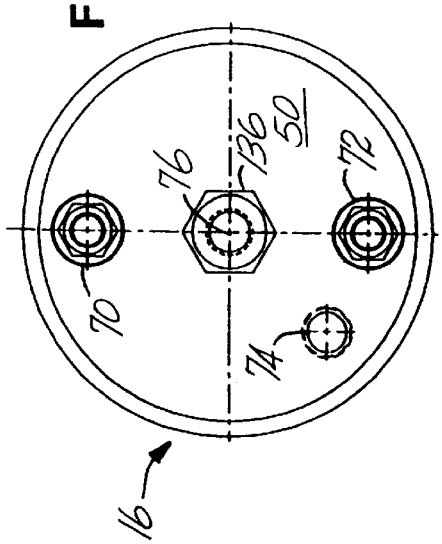
FIG. 2 is a bottom end view of the improved heat exchanger of FIG. 1.

With reference also to FIGS. 2 and 3, the bottom end plate 16 and the top end plate 18 are preferably circular and are preferably made from stainless steel or another corrosion resistant material (although in many applications a non-corrosion resistant material is suitable). Since, the top end plate 18 and the bottom end plate 16 are identical, both will be described interchangeably, it being understood that the top and bottom end plates are similarly configured.

The end plates 16 and 18 have an outer surface 50, an inner surface 52, and a beveled outer side wall 54. The inner surface 52 includes a radially outer annular surface 56 and an inner central portion 58 that axially protrudes from the outer annular surface 56. The inner central portion 58 is preferably circular in shape and has a radially outwardly facing side wall 60 that defines a groove 62 extending around the periphery of the inner central portion 58. The annular surface 56 defines a groove 64 around its periphery near the beveled side wall 54.

Preferably, the inner central portion 58 is sized such that the inner casing 19 can be mounted around the inner central portion 58 against the radially outwardly facing side wall 60, with an O-ring 66 located in the groove 62 to provide a suitable seal between the inner casing 19 and the end plate. The inner casing 19 may be contacting or slightly spaced from the outer annular surface 56. The outer casing 20 preferably abuts against the outer annular surface 56 around its periphery near the beveled side wall 54 with an O-ring 68 located in the groove 64 to provide a suitable seal between the outer casing 20 and the end plate. Alternatively, the end plates 16 and 18 may be provided with a central recessed portion (not shown) rather than the central protruding portion 58. In this case, the inner casing 19 would be inserted into the recess and abut a radially inwardly facing wall.

With reference to FIG. 2, the bottom end plate 16 includes three circular ports located near the periphery of the bottom end plate 16. A first port 70 accepts and retains the first end 40 of the outer coiled tube 28. A second port 72 accepts and retains the first end 36 of the inner coiled tube 26. A third port 74 acts as an inlet for the coolant and can also function as a drain for the coolant. The bottom end plate 16 also includes a centrally disposed opening 76 for receiving a fastener which will be described in more detail below.

With reference to FIG. 3, the top end plate 18 includes three circular ports located near the periphery of the top end plate 18. A first port 80 accepts and retains the second end 38 of the inner coiled tube 26. A second port 82 accepts and retains the second end 42 of the outer coiled tube 28. A third port 84 acts as an outlet for the coolant and can also function as a vent for the coolant. The top end plate 18 also includes a centrally disposed opening 86 for receiving a fastener which will be described in more detail below.

Figure 4:
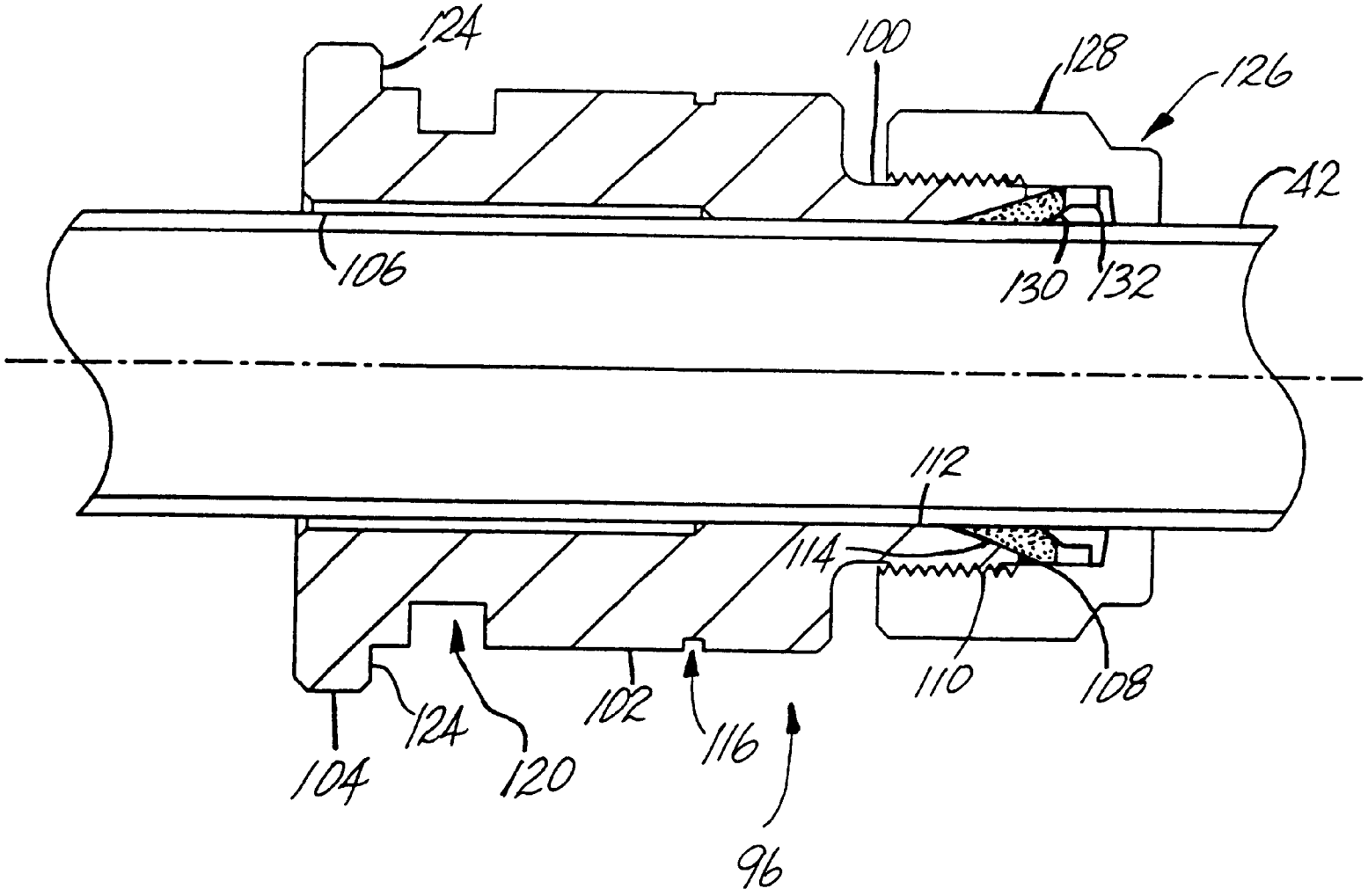
FIG. 4 is a sectional view of a bulkhead fitting according to the present invention.

The improved heat exchanger 10 also includes four bulkhead fittings 90, 92, 94, and 96 for connecting the ends of the coiled tubes to the end plates. Since all of the bulkhead fittings 90, 92, 94, and 96 are identical, only the bulkhead fitting 96 will be described in detail, it being understood that the other bulkhead fittings 90, 92, and 94 are similarly configured. With reference to FIG. 4, the bulkhead fitting 96 has a cylindrical outer portion 100, a cylindrical central portion 102, an inner flange portion 104, and a centrally disposed circular bore 106 for accepting and retaining the end 42 of the outer coiled tube 28. The outer portion 100 is radially smaller than the central portion 102 and has an outer end 108, a threaded outer wall 110, and an inner wall 112 having a tapered portion 114. The central portion 102 is sized to fit securely in one of the openings of the bottom or top end plates 16 and 18. The central portion 102 has a peripheral groove 116 for receiving a snap ring 118 to securely attach the bulkhead fitting 96 to the top end plate 18. The central portion 102 also has a peripheral groove 120 preferably adjacent to the inner flange portion 104, for receiving an O-ring 122 to form a seal between the bulkhead fitting 96 and the top end plate 18. Alternatively, graphite gaskets can be used instead of O-rings. The inner flange portion 104 is radially larger than the central portion 102 and has an annular surface 124 that will abut the outer annular surface 56 of the inner surface 52 of the top end plate 18.

The fitting 126 is designed to mechanically seal the bulkhead fitting 96 to the end 42 of the outer coiled tube 28. The fitting 126 is preferably a compression type fitting that is a well known to those skilled in the art, e.g. a Swagelok® fitting. The fitting includes a nut 128, a front ferrule 130, and a back ferrule 132. The front ferrule 130 is wedge-shaped and rests within the tapered portion 114 of the inner wall 112 of the outer portion 100 of the bulkhead fitting 96 and is sandwiched between the end 42 of the outer coiled tube 28 and the inner wall 112. The back ferrule 132 is ring-shaped and rests on top of the front ferrule 130. The nut 128 has a bore that accepts end 42 of the outer coiled tube 28 and fits over the back ferrule 132 and the front ferrule 130. The nut 128 is threaded to the outer wall 110 of the outer portion 100 of the bulkhead fitting 96 by tightening the nut 128. Although a preferred compression fitting is described above, it should be appreciated that many different types of compression fittings known in the art may be used.

Assembly of the improved heat exchanger 10, preferably proceeds as follows. The inner casing 19 is placed inside the outer casing 20. The tube bundle 14 is then inserted into the annular space 21 between the inner and outer casings 19 and 20. Preferably, the inner and outer baffles 34 and 30 and the separating plate 32 are mounted to the coils of the inner and outer coiled tubes 26 and 28 prior to insertion into the shell assembly 12. The tube bundle 14 has a suitable cross sectional width to facilitate entry into the annular space 21, yet provide a snug fit. There can be a slight clearance between the inner baffle 34 and the inner casing 19 and between the outer baffle 30 and the outer casing 20 to facilitate assembly and disassembly.

Next, the bulkhead fittings 94 and 96 are attached to the top end plate 18. Bulkhead fitting 94 fits within the first port 80 of the top end plate 18 and bulkhead fitting 96 fits within the second port 82 of the top end plate 18. The bulkhead fittings 94 and 96 are properly sealed to the top end plate 18 by the use of O-rings 122 which are placed in the peripheral grooves 120 of the central portions 102 of the bulkhead fittings. The annular surface 124 of the inner flange portion 104 of the bulkhead fittings abuts firmly against the outer annular surface 56 of the inner surface 52 of the top end plate 18. The bulkhead fittings 94 and 96 are secured to the top end plate 18 by the use of snap rings 118. Alternatively, jam nuts may be threaded onto the bulkhead fittings 94 and 96 releasably securing the bulkhead fittings 94 and 96 to the top end plate 18.

The top end plate 18 may now be placed on the top of the shell assembly 12 such that the ends 42 and 38 of the outer and inner coiled tubes 28 and 26 fit through the axial bores 106 of the bulkhead fittings 96 and 94. The outer casing 20 preferably abuts against the outer annular surface 56 of the top end plate 18 around its periphery near the beveled side wall 54 such that an O-ring 68 fits within the peripheral groove 64 of the outer annular surface 56 of the top end plate 18, thus providing a proper seal between top end plate 18 and the outer casing 20. The inner casing 19 is mounted around the inner central portion 58 of the top end plate 18 against the radially outwardly facing side wall 60 such that the O-ring 66 fits within the groove 62 extending around the inner central portion 58, thus providing a proper seal between the top end plate 18 and the inner casing 19.

Preferably, the bulkhead fittings 96 and 94 can now be mechanically sealed to the ends 42 and 38 of the outer coiled tube 28 and the inner coiled tube 26 by the use of compression fittings 126. For example, by tightening nut 128, the front ferrule 130 deforms the end 42 of the outer coiled tube 28, and mechanically seals the end 42 of the outer coiled tube 28 to the bulkhead fitting 96. This method of mechanically sealing tubes to fittings is commonly known as swaging. Alternatively, the bulkhead fittings 96 and 94 can be brazed, welded, or shrunk to the outer and inner coiled tubes 28 and 26 prior to insertion of the tube bundle 14 into the shell assembly 12. Assembly of the bottom end 22 of the improved heat exchanger 10 proceeds in the same manner and therefore a description is not repeated here.

Next, the bottom and top end plates 16 and 18 can be secured to the outer casing 20 by placing a threaded bolt 134 through the centrally disposed opening 76 of the bottom end plate 16, through the center of the inner casing 19, and through the centrally disposed opening 86 of the top end plate 18. Nuts 136 are then placed on each end of the bolt 134 and tightened, thus applying pressure against the end plates and securing the end plates to the outer casing 20. Preferably, the outer baffle 30 and the inner baffle 34 of the tube bundle 14 have a sufficient length such that the ends of the baffles are in close or abutting contact with the end plates after the nuts have been tightened. The center bolt 134 provides a means to relieve excessive pressure that may build up in the shell assembly 12. In particular, at a predetermined pressure, the center bolt 134 will elongate enough such that the bottom end plate 16 and the top end plate 18 are permitted to separate from the outer casing 20. At this point the O-rings 68 sealing the outer casing 20 to the end plates will unseat and relieve pressure from within the shell assembly 12. The center bolt size and torque can be designed to meet normal shell assembly pressure requirements and provide for over pressure protection.

Preferably, compression fittings 138 are assembled near all the ends 36, 40, 38, and 42 of the inner and outer coiled tubes 26 and 28 which can be used to connect the tubes to various union, elbow, and Tee connectors. These various connectors allow the tubes to be connected to various other external tubes and devices allowing fluid inlet and outlet connections to be made external to the shell assembly 12. As the various modes of operation below illustrate, these various union, elbow, or Tee connectors can be used to configure the improved heat exchanger 10 to operate with differing flows patterns by the connection of different external tube configurations. The swaging of the tubes to the compression fittings occurs in a similar manner to that previously described in the swaging of the tubes to the bulkhead fittings. Although compression fittings are preferred, it should be appreciated that many different types of fittings may be used.

An advantage of using external connections is that it eliminates coiled tube leakage from contaminating the coolant. In prior art embodiments coiled tubes were sometimes connected to each other using various fittings within the casing, through which the coolant would flow. These fittings would occasionally leak and the working fluid would contaminate the coolant. Since all the tube connections in the improved heat exchanger 10 are made with external connectors there is no chance of fluid leakage contaminating the coolant.

Although the preferred method of assembly is described above, it should be appreciated that many different sequences and methods of assembly are possible.

Figure 5:
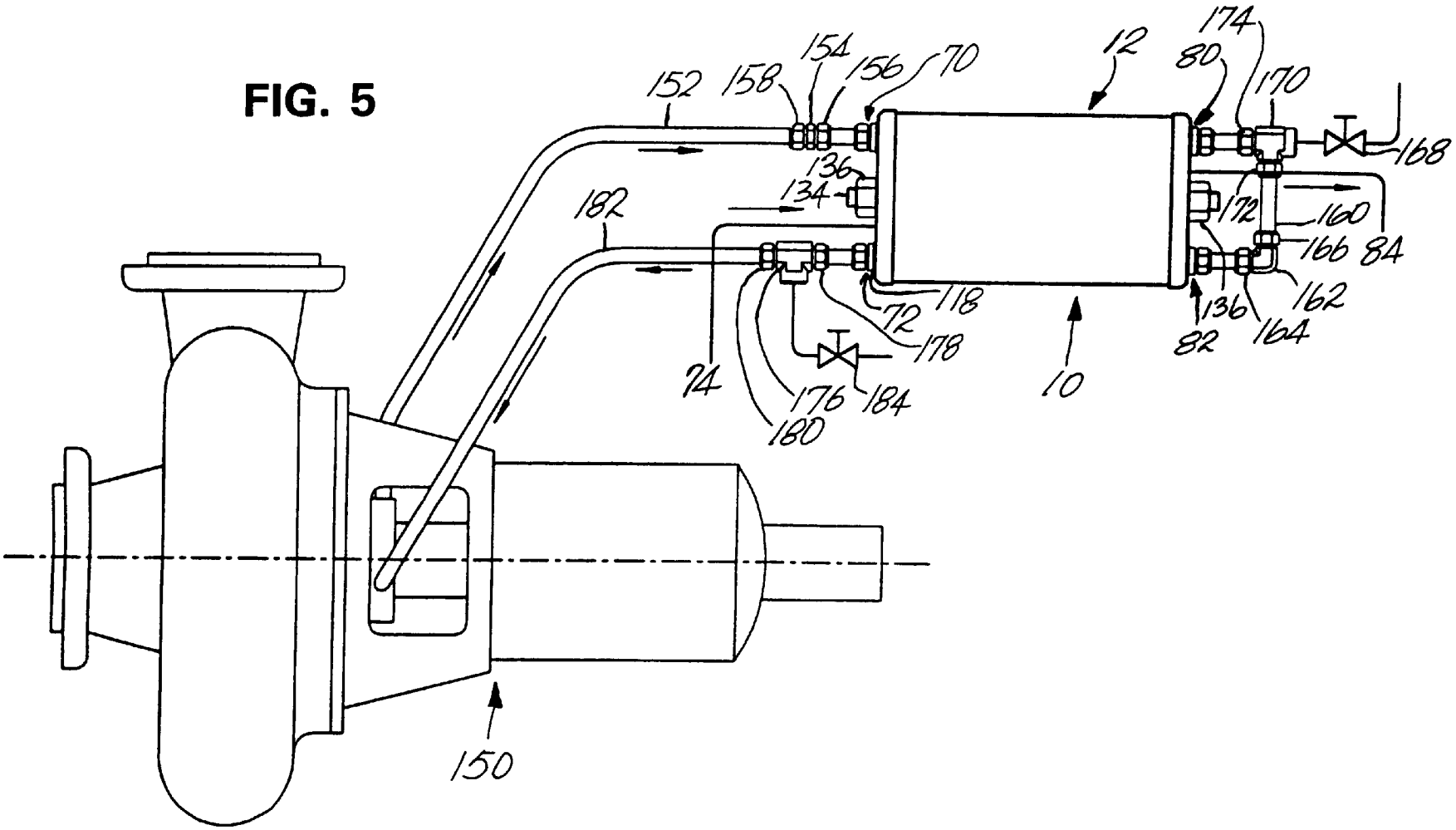
FIG. 5 is a schematic showing the improved heat exchanger in a double pass horizontal mount configuration.

The improved heat exchanger 10 of the present invention may be connected to a pump in several different ways depending on the installation requirements and the desired characteristics of the heat exchanger. With reference to FIG. 5, the improved heat exchanger 10 is mounted horizontally and fluid travels from a pump 150 through a fluid delivery tube 152 to the improved heat exchanger 10. A union connector 154 connects the end 40 of the outer coiled tube 28 to the fluid delivery tube 152 by compression fittings 156 and 158. The fluid enters the first end of shell assembly 12 at port 70 and travels through the coil of the outer coiled tube 28 and exits the second end of the shell assembly 12 at port 82. Port 82 is connected to port 80 by an external tube 160. The end 42 of the outer coiled tube 28 is connected to the external tube 160 by an elbow connector 162 and compression fittings 164 and 166. The external tube 160 is then connected to end 38 of the inner coiled tube 26 and to a vent 168 by a Tee connector 170 and compression fittings 172 and 174. The fluid travels from port 82 through the external tube 160 and then reenters the second end of shell assembly 12 at port 80 and travels through the inner coiled tube 26. The fluid then exits the first end of shell assembly 12 at port 72. A Tee connector 176 and compression fittings 178 and 180 connect the end 36 of the inner coiled tube 26 to a fluid return tube 182 and to a drain 184. The fluid then returns to the pump 150 through the fluid return tube 182. The fluid thus makes a double pass, once in each direction, through the shell assembly 12. This embodiment is referred to as the double pass horizontal mount.

Coolant enters the first end of shell assembly 12 through the coolant inlet port 74 of the bottom end plate 16 flowing into the annular space 21 (See also FIG. 2). The inner baffle 34, the outer baffle 30, and the separating plate 32 help to channel the coolant over the coiled tubes, forcing the coolant to spiral over the coils. The coolant is channeled through the first separate chamber 44 and the second separate chamber 46 and is carried in a helical path along each convolution of the coils of the inner coiled tube 26 and the outer coiled tube 28 in a single pass flow through design and then exits through the second end of the shell assembly 12 at coolant outlet port 84 of the top end plate 18. This is advantageous in that the amount of coolant that reaches the surface area of the coiled tubes is maximized by the channeling effect of the separate chambers and therefore heat transfer is also maximized. Therefore, the use of separate chambers increases the amount of coolant that contacts the outer surface of the coils, thus increasing the efficiency of the heat transfer between the fluid in the coils and the coolant.

Since the coolant passes through one end of the shell assembly 12 and out the other in a single pass, the coolant dwells in the shell assembly 12 for a shorter period of time, as compared to the double pass flow of coolant in the prior art, preventing the temperature of the coolant from rising unnecessarily. The coolant can also be introduced at the coolant outlet port 84 and thus flow in reverse towards the hotter fluid inlet side. This can reduce thermal shock and reduce scaling. Also, since the cooling liquid flows through the shell assembly 12 in a single pass, it can more effectively carry small particles of rust and dirt with it. This helps reduce solids buildup within the shell assembly 12.

The inner coil ports 80 and 72 are preferably located 180 degrees apart to provide a high point vent 168 and a low point drain 184, respectively. The high point vent 168 is located above the improved heat exchanger 10. This allows venting to eliminate gas or vapor pockets from within the tubes. The drain 184 is located below the improved heat exchanger 10.

The coolant, typically water, will almost invariably contain at least trace amounts of impurities. Further, even if all of the components are formed from materials resistant to corrosion, at least some chemical breakdown of the components can occur over an extended period of use. These contaminants can eventually build-up along the coolant's path of travel restricting the flow of coolant as well as insulating transfer of thermal energy between the fluid and the coolant. Thus, to minimize these effects, the improved heat exchanger 10 preferably receives periodic maintenance and cleaning. This requires access to the interior components best attainable by removing the tube bundle 14 from the shell assembly 12.

Preferably, disassembly and cleaning of the improved heat exchanger 10 proceeds as follows. First, the coolant is removed through the inlet port 74 which functions as a drain for the coolant. Also, the working fluid is preferably drained using the drain 184. Then, the improved heat exchanger 10 is disconnected from the pump 150 and the vent 168. The nuts 136 are then removed from the center bolt 134, and the center bolt 134 is removed from the shell assembly 12. The snap rings 118 are removed from the bulkhead fittings. Next, the bottom end plate 16 and the top end plate 18 can be tapped off the ends of the coiled tubes. Once the end plates have been removed, the inner casing 19 can be removed by supporting the outer casing 20 and by pulling or pushing the inner casing 19 off the tube bundle 14. The outer casing 20 can then be pulled or pushed off of the tube bundle 14.

After the tube bundle 14 has been removed from the shell assembly 12, the outer and inner baffles 30 and 34 may be removed from the coils of the outer and inner coiled tubes 28 and 26 to allow access for cleaning. Slits along each baffle allow the edges to be grasped and removed by peeling them from the surfaces of the coils. After the casings and coiled tubes have been cleaned, new baffles can be attached, and the tube bundle 14 can be replaced in the shell assembly 12 until the next required cleaning or maintenance.

Figure 6:
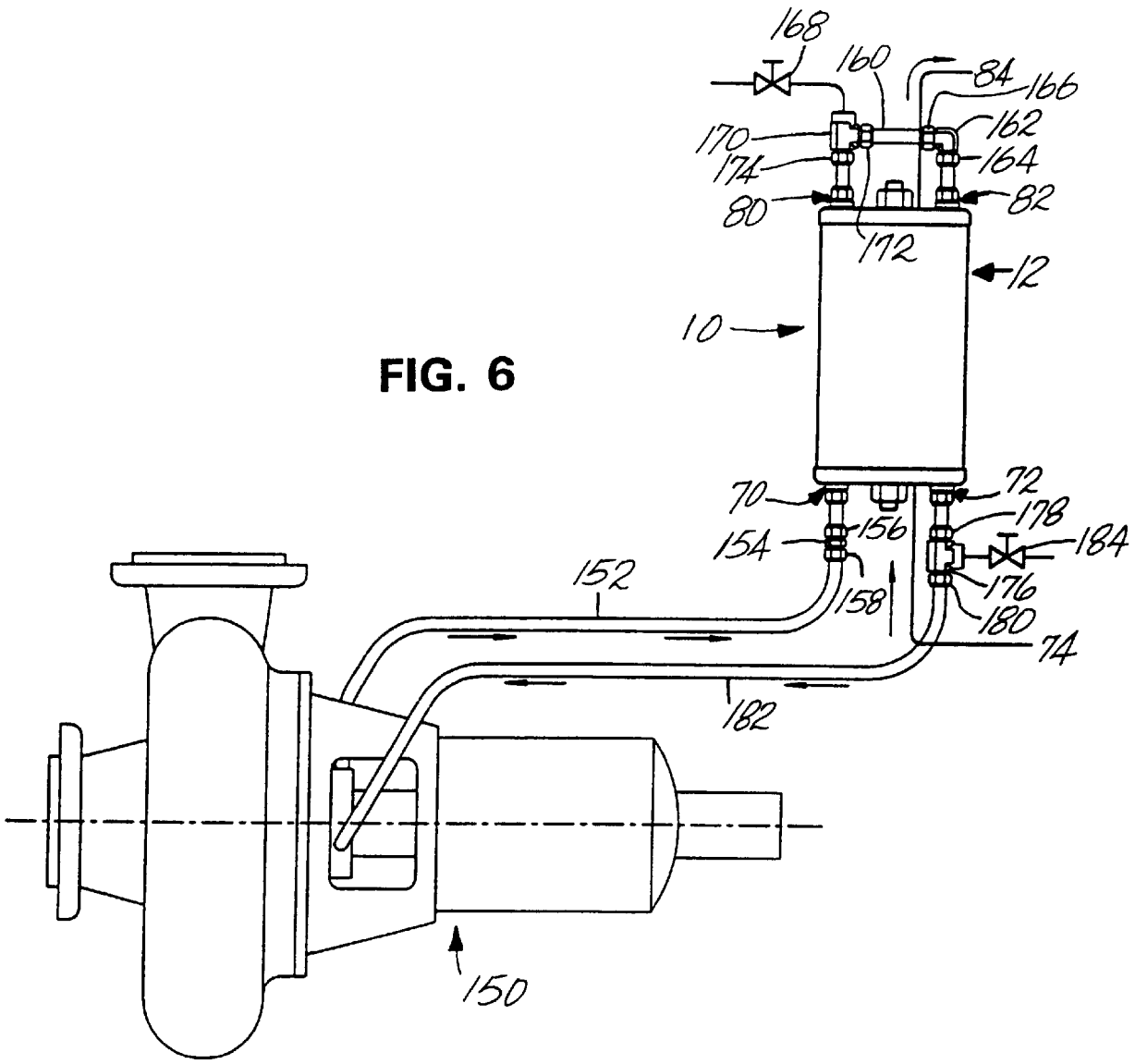
FIG. 6 is a schematic showing the improved heat exchanger in a double pass vertical mount configuration.

With reference to FIG. 6, the improved heat exchanger 10 is mounted vertically and fluid travels from the pump 150 through the fluid delivery tube 152 to the improved heat exchanger 10. The union connector 154 connects the end 40 of the outer coiled tube 28 to the fluid delivery tube 152 by compression fittings 156 and 158. The fluid enters at the first end of the shell assembly 12 at port 70 and travels through the coil of the outer coiled tube 28 and exits the second end of the shell assembly 12 at port 82. Port 82 is connected to port 80 by an external tube 160. The end 42 of the outer coiled tube 28 is connected to the external tube 160 by an elbow connector 162 and compression fittings 164 and 166. External tube 160 is then connected to the end 38 of the inner coiled tube 26 and to a vent 168 by a Tee connector 170 and compression fittings 172 and 174. The fluid travels from port 82 through the external tube 160 and then reenters second end of the shell assembly 12 at port 80 and travels through the coil of the inner coiled tube 26. The fluid then exits the first end of the shell assembly 12 at port 72. A Tee connector 176 and compression fittings 178 and 180 connect the end 36 of the inner coiled tube 26 to a fluid return tube 182 and to a drain 184. The fluid then returns to the pump 150 through the fluid return tube 182. The fluid thus makes a double pass, once in each direction, through the shell assembly 12. This embodiment is referred to as the double pass vertical mount.

Coolant enters the shell assembly 12 through the coolant inlet port 74 of the bottom end plate 16. The coolant flows into the annular space 21 and is carried in a helical path along each convolution of the coils of the inner coiled tube 26 and the outer coiled tube 28 in a single pass flow through design and then exits through coolant outlet port 84 of the top end plate 18.

The inner coil ports 80 and 72 are located 180 degrees apart to provide a high point vent 168 and a low point drain 184, respectively. A high point vent 168 is located above the improved heat exchanger 10. This allows venting to eliminate gas or vapor pockets from within the tubes. A drain 184 is located below the improved heat exchanger 10, and is used to drain the fluid from the tubes of the improved heat exchanger 10 during repair or maintenance. Since all tube connections are outside of the shell assembly 12 it is easy to plumb the heat exchanger to achieve the desired venting and draining. Venting is most effective when the improved heat exchanger 10 is mounted in the vertical position. Draining is also most effective when the improved heat exchanger 10 is mounted in the vertical position since both the inner and outer coiled tubes 26 and 28 can be completely drained.

Figure 7:
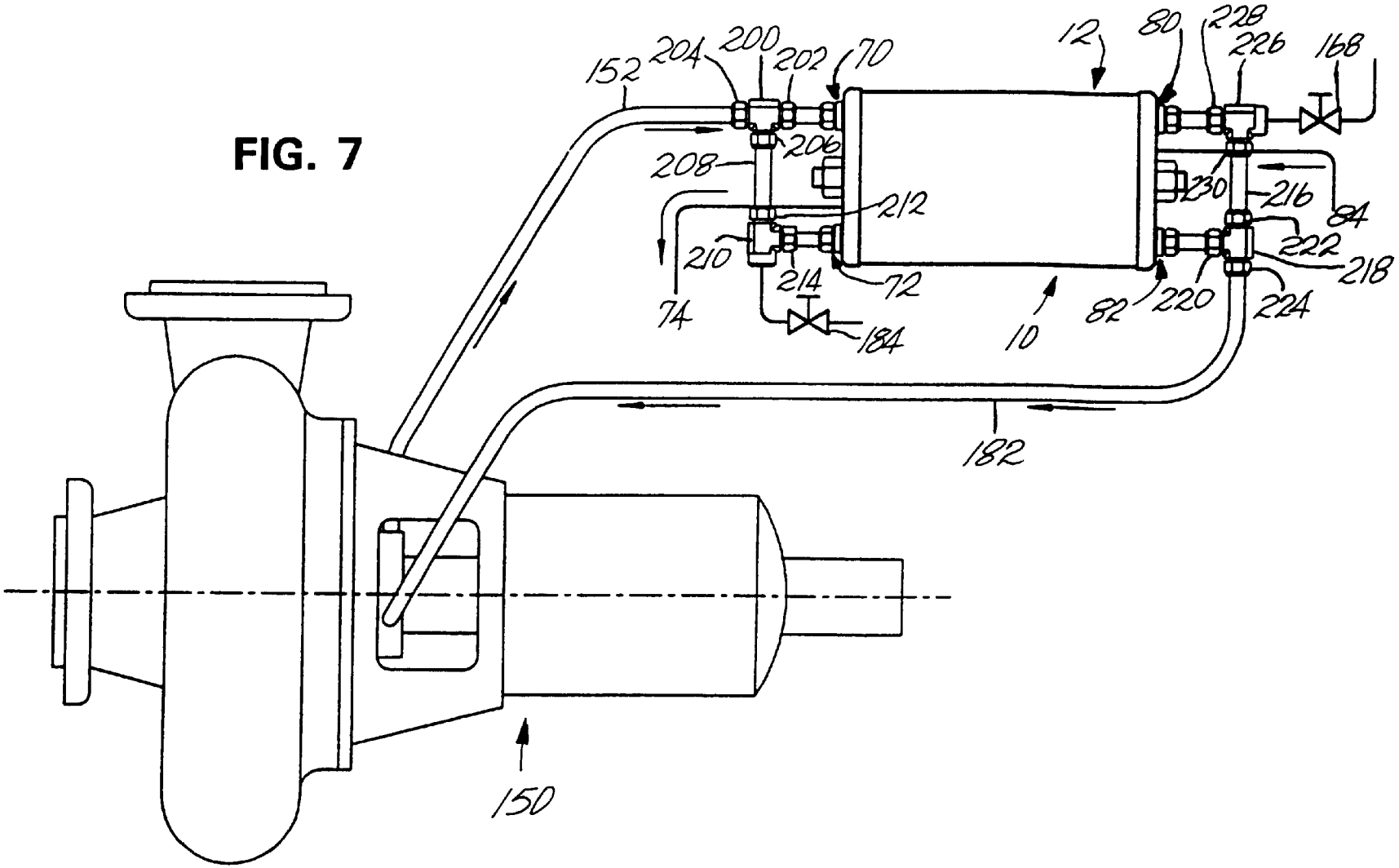
FIG. 7 is a schematic showing the improved heat exchanger in a single pass horizontal mount configuration.

With reference to FIG. 7, the improved heat exchanger 10 is mounted horizontally and fluid travels from the pump 150 through the fluid delivery tube 152 to the improved heat exchanger 10. A first Tee connector 200 and compression fittings 202, 204, and 206 connect the end 40 of the outer coiled tube 28 to the fluid delivery tube 152 and to an external tube 208. The external tube 208 connects to a second Tee connector 210 by a compression fitting 212. The fluid travels from the first Tee connector 200 through the external tube 208 to the second Tee connector 210. The second Tee connector 210 and compression fittings 212 and 214 connect the external tube 208 with the end 36 of the inner coiled tube 26 and to a drain 184. Therefore, the fluid enters the first end of the shell assembly 12 at ports 70 and 72 and travels through the coil of the outer coiled tube and the inner coiled tube 28 and 26, respectively, exiting the second end of the shell assembly 12 at ports 82 and 80. Port 82 is connected to port 80 by an external tube 216. The end 42 of the outer coiled tube 28 is connected to an external tube 216 and to a fluid return tube 182 by a third Tee connector 218 and compression fittings 220, 222, and 224. The external tube 216 is connected to the end 38 of the inner coiled tube 26 and to a vent 168 by a fourth Tee connector 226 and compression fittings 228 and 230. Therefore, the fluid exits the second end of the shell assembly 12 at ports 82 and 80 and then travels through the fluid return tube 182 back to the pump 150. Thus the fluid makes a single pass through the shell assembly 12. This embodiment is referred to as the single pass horizontal mount.

Coolant enters the second end of the shell assembly 12 through the coolant outlet port 84 of the top end plate 18. The coolant flows into the annular space 21 and is carried in a helical path along each convolution of the coils of the inner coiled tube 26 and the outer coiled tube 28 in a single pass flow through design and then exits through the first end of the shell assembly 12 the coolant inlet port 74 of the bottom end plate 16. This embodiment illustrates the improved heat exchanger's 10 counter flow capability. The coolant is introduced at the coolant outlet port 84 and thus flows in reverse towards the hotter fluid inlet side and then exits through the coolant inlet port 74. This coolant flow pattern reduces thermal shock and reduces scaling.

The inner coil ports 80 and 72 are preferably located 180 degrees apart to provide a high point vent 168 and a low point drain 184, respectively. The high point vent 168 is located above the improved heat exchanger 10. This allows venting to eliminate gas or vapor pockets from within the tubes. The drain 184 is located below the improved heat exchanger 10.

Figure 8:
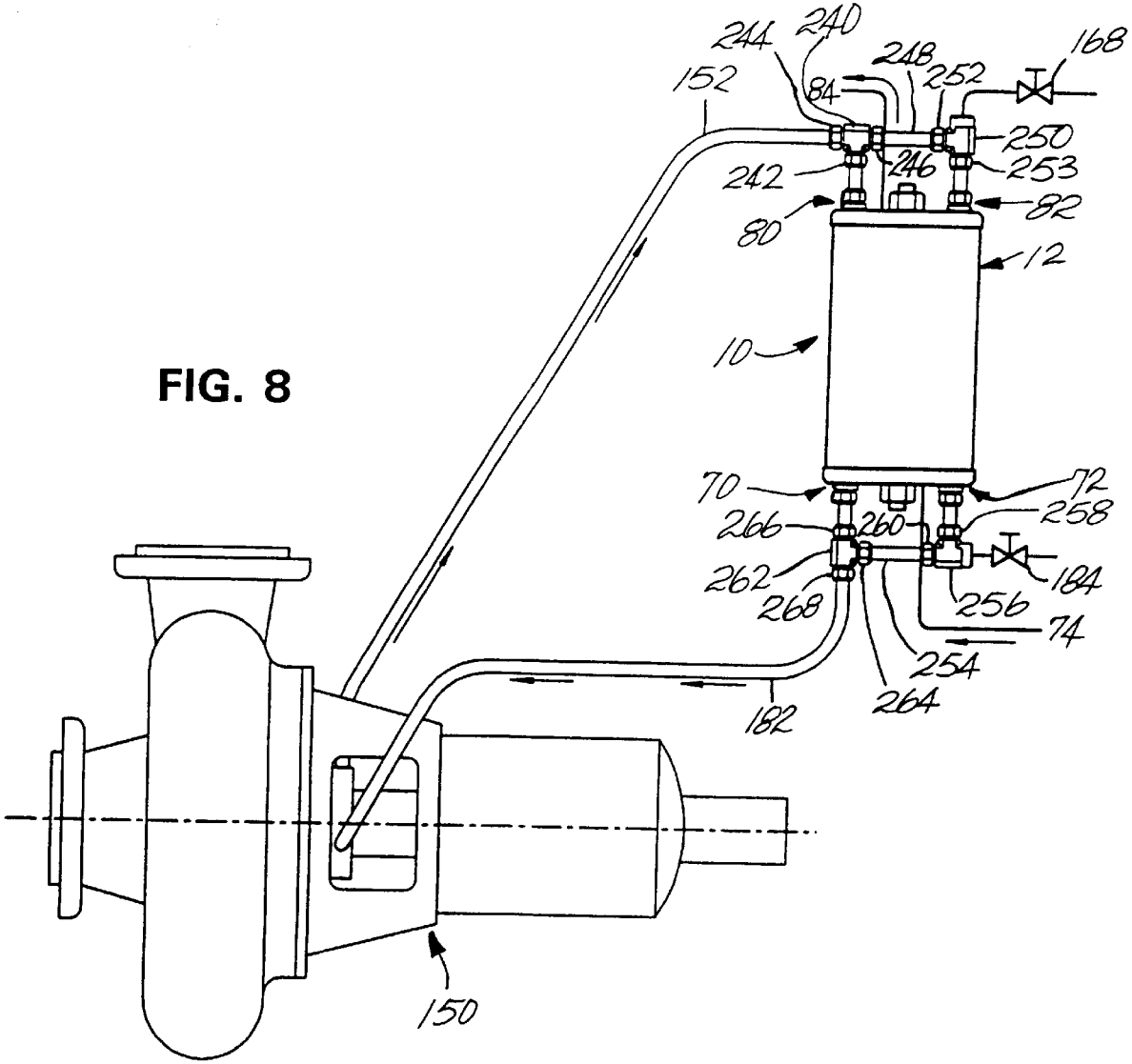
FIG. 8 is a schematic showing the improved heat exchanger in a single pass vertical mount configuration.

With reference to FIG. 8, the improved heat exchanger 10 is mounted vertically and fluid travels from the pump 150 through a fluid delivery tube 152 to the improved heat exchanger 10. A first Tee connector 240 and compression fittings 242, 244, and 246 connect the end 38 of the inner coiled tube 26 to the fluid delivery tube 152 and to an external tube 248. The external tube 248 connects to a second Tee connector 250 by a compression fitting 252. The fluid travels from the first Tee connector 240 through the external tube 248 to the second Tee connector 250. The second Tee connector 250 and compression fittings 252 and 253 connect the external tube 248 with the end 42 of the outer coiled tube 28 and to a vent 168. Therefore, the fluid enters the first end of the shell assembly 12 at ports 80 and 82 and travels through the coil of the inner coiled tube 26 and the outer coiled tube 28, respectively, and exits the second end of the shell assembly 12 at ports 72 and 70. Port 72 is connected to port 70 by an external tube 254. The end 36 of the inner coiled tube 26 is connected to the external tube 254 and to a drain 184 by a third Tee connector 256 and compression fittings 258 and 260. The external tube 254 is connected to the end 40 of the outer coiled tube 28 and to a fluid return tube 182 by a fourth Tee connector 262 and compression fittings 264, 266, and 268. Therefore, the fluid exits the second end of the shell assembly 12 at ports 72 and 70 and then travels through the fluid return tube 182 back to the pump 150. Thus the fluid makes a single pass through the shell assembly 12. This embodiment is referred to as the single pass vertical mount.

Coolant enters the second end of the shell assembly 12 through the coolant inlet port 74 of the bottom end plate 16. The coolant flows into the annular space 21 and is carried in a helical path along each convolution of the coils of the inner coiled tube 26 and the outer coiled tube 28 in a single pass flow through design and then exits through the first end of the shell assembly 12 at the coolant outlet port 84 of the top end plate 18.

A high point vent 168 is located above the improved heat exchanger 10. This allows venting to eliminate gas or vapor pockets from within the tubes. A low point drain 184 is located below the improved heat exchanger 10 and is used to drain the fluid from the tubes of the improved heat exchanger 10 during repair or maintenance.

It should be appreciated that these previously illustrated embodiments are only exemplary and therefore other embodiments are not excluded.

It should be appreciated that the improved heat exchanger can be constructed from standard pipes and common hardware. The inner casing, the outer casing, the inner coiled tube, and the outer coiled tube can all be made from various sized standard pipes. Also, different bulkhead fittings, end plates, nuts, bolts, and fittings, all of various sizes, can be used to construct the improved heat exchanger. Further, as previously illustrated, the improved heat exchanger can be configured to operate in single pass mode where fluid makes only one pass through the improved heat exchanger or in a double pass mode where the fluid passes twice through the improved heat exchanger. This can be accomplished by simply modifying standard, commercially available, external tube connections as the various embodiments illustrate. In addition the tube bundle can be lengthened or shortened to accommodate varying heat transfer requirements. Thus a range of heat exchanger capacities can be accommodated using the same end plates and fittings. The use of standard pipes and common hardware provide a cost effective solution for a corrosion resistant improved heat exchanger.

Although the invention has been described in detail with reference to only a few preferred embodiments, those having ordinary skill in the art will appreciate that various modifications can be made without departing from the spirit of the invention. For example, it should be understood that this device could also be used to raise the temperature of a fluid simply by replacing the coolant with a fluid that is warmer than the fluid. With such possibilities in mind, the invention is defined with reference to the following claims.

We claim:

1. A method for servicing a heat exchanger that is connected to a fluid delivery tube for receiving working fluid from a working fluid source and connected to a fluid return tube for returning working fluid to the working fluid source, wherein the heat exchanger includes:

an inner casing;

an outer casing around the inner casing forming an annular space therebetween, the outer casing having a first end and a second end;

a tube bundle including a first tube through which one of said working fluid and coolant flows, the first tube having a first end, a second end and a helical coil formed between the first and second ends of the first tube, wherein the helical coil is located in the annular space between the inner and outer casings;

a first end plate removably secured and sealed to the first end of the outer casing, the first end plate having an opening through which the first end of the first tube passes;

a second end plate removably secured and sealed to the second end of the outer casing, the second end plate having an opening through which the second end of the first tube passes;

a first bulkhead fitting detachably mounted in the opening of the first end plate, the first bulkhead fitting sealed to the first end of the first tube passing therethrough; and a second bulkhead fitting detachably mounted in the opening of the second end plate, the second bulkhead fitting sealed to the second end of the first tube passing therethrough;

wherein the first and second bulkhead fittings are sized to permit the first and second end plates, respectively to be moved off of the respective bulkhead fittings in a direction away from the helical coil, wherein the servicing method comprises:

disconnecting the heat exchanger from the fluid delivery tube and the fluid return tube;

removing the first and second end plates off of the respective bulkhead fittings in a direction away from the helical coil;

removing the inner and outer casings off of the tube bundle.

2. The servicing method of claim 1, further comprising reassembling the heat exchanger and reconnecting the heat exchanger to the fluid delivery tube and the fluid return tube.

3. The servicing method of claim 1, wherein the inner and outer casings are removed off of the tube bundle one at a time.

4. A method for servicing a heat exchanger that is connected to a fluid delivery tube for receiving working fluid from a working fluid source and connected to a fluid return tube for returning working fluid to the working fluid source, wherein the heat exchanger includes:

an inner casing;

an outer casing around the inner casing forming an annular space therebetween, the outer casing having a first end and a second end;

a tube bundle including a plurality of tubes through which one of said working fluid and coolant flows, each of the plurality of tubes having a first end, a second end and a helical coil formed between the first and second ends, wherein the helical coils of the plurality of tubes are located in the annular space between the inner and outer casings and the helical coil of a first one of the plurality of tubes is spaced from and located radially inside the helical coil of a second one of the plurality of tubes;

a first end plate removably secured and sealed to the first end of the outer casing, the first end plate having a plurality of openings through which the first ends of the plurality of tubes pass, respectively;

a second end plate removably secured and sealed to the second end of the outer casing, the second end plate having a plurality of openings through which the second ends of the plurality of tubes pass, respectively; and a separating plate extending longitudinally and located between the helical coil of the first one of the plurality of tubes and the helical coil of the second one of the plurality of tubes such that the other of said working fluid and coolant flows through two separate passages, a first one of the separate passages between the inner casing and the separating plate and a second one of the separate passages between the outer casing and the separating plate;

wherein the servicing method comprises:

disconnecting the heat exchanger from the fluid delivery tube and the fluid return tube;

removing the first and second end plates off in a direction away from the helical coil;

removing the inner and outer casings off of the tube bundle.

5. The servicing method of claim 4, further comprising reassembling the heat exchanger and reconnecting the heat exchanger to the fluid delivery tube and the fluid return tube.

6. The servicing method of claim 4, wherein the inner and outer casings are removed off of the tube bundle one at a time.

7. A method for servicing a heat exchanger that is connected to a fluid delivery tube for receiving working fluid from a working fluid source and connected to a fluid return tube for returning working fluid to the working fluid source, wherein the heat exchanger includes:

an inner casing;

an outer casing around the inner casing forming an annular space there between, the outer casing having a first end and a second end;

a tube bundle including a plurality of tubes through which the working fluid is permitted to flow, each of the plurality of tubes having a first end, a second end and a helical coil formed between the first and second ends, wherein the helical coils of the plurality of the tubes are located in the annular space between the inner and outer casings and the helical coil of a first one of the plurality of tubes is spaced from and located radially inside the helical coil of a second one of the plurality of tubes;

a first end plate sealed to the first end of the outer casing, the first end plate having a plurality of openings through which the first ends of the plurality of tubes pass, respectively;

a second end plate sealed to the second end of the outer casing, the second end plate having a plurality of openings through which the second ends of the plurality tubes pass, respectively;

a fluid delivery tube for receiving working fluid from the working fluid source connected to the first end of one of the first one and the second one of the plurality of tubes;

an external outlet tube connecting the second end of the first one of the plurality of tubes to the second end of the second one of the plurality of tubes; and a fluid return tube for returning working fluid to the working fluid source after the working fluid has passed through the annular space;

wherein the servicing method comprises:

disconnecting the heat exchanger from the fluid delivery tube and the fluid return tube;

removing the first and second end plates off of the outer case in a direction away from the helical coil;

removing the inner and outer casings off of the tube bundle.

8. The servicing method of claim 7, further comprising reassembling the heat exchanger and reconnecting the heat exchanger to the fluid delivery tube and the fluid return tube.

9. The servicing method of claim 7, wherein the inner and outer casings are removed off of the tube bundle one at a time.

10. The servicing method of claim 8, further comprising:

connecting an external tube between the first end of the first tube and the first end of the second tube; and splitting the flow of the working fluid between the helical coils of the first and second tubes resulting in a parallel, single-pass flow through the annular space.

11. The servicing method of claim 8, further comprising:

directing the flow from one of the helical coils of the first and second tubes to the other of the helical coils of the first and second tubes in a series, double-pass through the annular space.

* * * * *